US005247147A

United States Patent [19]

Boniort et al.

[11] Patent Number: 5,247,147

[45] Date of Patent: Sep. 21, 1993

[54] METHOD AND APPARATUS FOR HEATING A SILICA OPTICAL FIBER IN A FIBER-DRAWING INSTALLATION

[75] Inventors: Jean-Yves Boniort, Limours; Claude Brehm, Montrouge; Georges Roussy, Laxou, all of France

[73] Assignee: Alcatel N.V., Amsterdam, Netherlands

[21] Appl. No.: 858,586

[22] Filed: Mar. 27, 1992

[30] Foreign Application Priority Data

Mar. 29, 1991 [FR] France ..... 91 03879

[51] Int. Cl.[5] ..... H05B 6/64

[52] U.S. Cl. ..... 219/10.55 R; 219/10.55 A; 219/10.55 F; 219/10.55 M; 219/10.61 R; 65/3.11; 65/3.43; 118/620; 385/123; 385/128; 427/60; 428/608; 501/88

[58] Field of Search ..... 219/10.55 R, 10.55 F, 219/10.55 M, 10.55 A, 10.61; 385/123, 128; 427/45.1, 60, 163, 38, 249; 65/3.11, 3.43; 34/1; 118/620; 350/96.3, 96.34; 428/608; 501/88, 95

[56] References Cited

U.S. PATENT DOCUMENTS

| | | | |
|---|---|---|---|
| 4,694,586 | 9/1987 | Reznik | 427/45.1 |
| 4,863,760 | 9/1989 | Schantz et al. | 427/163 |
| 5,021,072 | 6/1991 | Atkins et al. | 427/45.1 |
| 5,035,484 | 7/1991 | Ishiguro et al. | 385/123 |
| 5,062,687 | 11/1991 | Sapsford | 385/123 |
| 5,114,738 | 5/1992 | Savage et al. | 427/163 |
| 5,130,130 | 5/1991 | Atkins et al. | 385/123 |

FOREIGN PATENT DOCUMENTS

| | | |
|---|---|---|
| 696417 | 9/1967 | Belgium . |
| 2318555 | 2/1977 | France . |
| 492377 | 7/1970 | Switzerland . |
| 554749 | 7/1943 | United Kingdom . |
| 619996 | 1/1949 | United Kingdom . |
| 1065971 | 4/1967 | United Kingdom . |
| 2053629 | 2/1981 | United Kingdom . |

*Primary Examiner*—Bruce A. Reynolds
*Assistant Examiner*—Tu Hoang
*Attorney, Agent, or Firm*—Sughrue, Mion, Zinn, Macpeak & Seas

[57] ABSTRACT

Apparatus for heating a silica optical fiber in a fiber-drawing installation. The apparatus is disposed at the outlet of a fiber-drawing oven to raise the optical fiber to a temperature greater than 1000° C. The apparatus is constituted by a microwave generator coupled to a resonant cavity formed by a helically-wound metal wire helix fixed at opposite ends to two short circuit metal plates respectively, with the optical fiber running substantially along the axis of the helix and the helix concentric about the running fiber.

7 Claims, 2 Drawing Sheets

METHOD AND APPARATUS FOR HEATING A SILICA OPTICAL FIBER IN A FIBER-DRAWING INSTALLATION

The present invention relates to a method and to apparatus for heating a silica optical fiber in a fiber-drawing installation.

BACKGROUND OF THE INVENTION

An optical fiber is usually covered by a sheath of plastic that serves two functions:

protecting the fiber against any external abrasion so as to retain its mechanical strength (it should be recalled that the mechanical strength of a fiber is limited by microcracks in its surface, and the greater the size of the microcracks, the less the mechanical strength); and protecting the fiber against sharp bends in the cable in which it is inserted, since sharp bends could degrade the optical properties of the fiber.

In certain applications, such as wire-guiding or various applications in industrial environments, the fiber is in the presence of a hostile atmosphere: water vapor, water, or corrosive liquids, e.g. oil and hydrogen.

Under the combined effects of such an environment and of mechanical stress, it is observed that the plastic covering is inadequate, microcracks grow and reduce the mechanical strength of the fibers. This phenomenon is known as corrosion under stress. In addition, if hydrogen diffusion is taking place, it is observed that the glass itself is degraded as are the optical properties of the fiber.

For all of the above reasons, it turns out to be essential to provide a hermetic coating of carbon on the fiber for the purpose of preventing the corrosive environment diffusing into contact with the surface of the fiber.

Such a coating can be made by pyrolysis of a gaseous hydrocarbon flowing through a reactor placed in an oven heated to about 1000° C. by the Joule effect. The fiber then runs longitudinally through the reactor.

The method is mentioned in an article published in "Journal of Lightwave Technology", Vol. 6, No. 2, February 1988, pp. 240–241 entitled "Recent developments in hermetically coated optical fiber" by K. E. Lu et al.

It is observed that implementing the above method causes a carbon deposit to be obtained that does not adhere well and that is incapable of providing adequate protection to the fiber.

It turns out that an essential condition for obtaining a carbon deposit of good quality is that the silica fiber should be at a sufficiently high temperature on entering the reactor, which temperature should be about 300° C. greater than the minimum pyrolysis temperature.

This condition could possibly be obtained if the reactor were located very close to the outlet of the fiber-drawing oven and if the fiber was running fast enough to avoid cooling down. To make this possible, the fiber-drawing speed must be greater than 150 meters per minute.

Since this fiber-drawing speed may be too high for the optical qualities of the fiber to be guaranteed, it is appropriate at lower speeds to interpose a heater device between the fiber-drawing oven and the reactor.

French patent FR-A-90 02 197 has already proposed solving this problem by means of a Joule effect oven. Such an oven suffers from drawbacks: it lacks efficiency because a silica fiber is transparent to infrared radiation; and it would need to be very long to obtain adequate heating.

An object of the present invention is to implement a method and apparatus for heating the fiber that is efficient and compact, suitable for raising the fiber to a temperature that enables a good quality carbon deposit to be obtained, regardless of the fiber-drawing speed; thereby making it possible to optimize both the carbon deposit and the optical characteristics of the fiber simultaneously.

SUMMARY OF THE INVENTION

The present invention provides a method of heating a silica optical fiber in a fiber-drawing installation to raise it to a temperature greater than 1000° C. on entering a pyrolysis reactor where it is to receive a carbon deposit, wherein said fiber is caused to run substantially along the axis of a microwave resonant cavity formed by a helically-wound metal wire which is fixed at both ends to two respective metal plates.

The present invention also provides apparatus for heating a silica optical fiber in a fiber-drawing installation, the apparatus being designed to be disposed at the outlet from the fiber-drawing oven to raise said fiber to a temperature greater than 1000° C., and comprising a microwave generator associated with coupling means for coupling it to a resonant cavity formed by a helically-wound metal wire fixed at its two ends to two "short circuit" metal plates respectively, said fiber being suitable for running substantially along the axis of the helix.

In a first embodiment, said apparatus includes a coaxial waveguide terminated by a dipole antenna associated with the helix by said coupling means, the dipole extending parallel to the axis of the helix. Means for adjusting the coupling may be provided, and in particular means for adjusting the distance between the dipole of said antenna and the axis of said helix.

In a second embodiment, said apparatus comprises a rectangular section monomode waveguide. In which case it is appropriate for the small side of said section to extend parallel to the axis of the helix. The maximum electric field directions in the helix and in the waveguide are thus parallel to each other and coupling is at a maximum.

In an improvement of the apparatus of the invention, it may include adjustment means for adjusting the pitch and the diameter of said helix, thereby adjusting the resonant frequency of said cavity; said adjustment means may be means for displacing at least one of said short circuit metal plates in rotation or in translation.

If the apparatus of the invention is placed close enough to the outlet from the fiber-drawing oven for the fiber to enter the apparatus at a temperature close to 900° C., the field confined inside the helix enables this temperature to be raised over a distance of about 10 cm to a temperature of 1400° C., at a fiber speed of 150 meters per minute.

By way of example, the power is about 500 watts at a frequency of 2.45 GHz.

The use of a resonant helix of the invention presents numerous advantages.

Thus, the axial electric field which is efficient in heating is considerably greater than in cavities having other configurations.

In addition, unlike other types of cavity, the resonant frequency of the helix does not change with the dielectric characteristics of the material it contains. This is fundamental for the application to which the present invention relates since the dielectric characteristics of a fiber change between 900° C. and 1400° C. The resonance of the cavity therefore needs to be adjusted once only, and the increase in the temperature of the fiber inside the cavity does not change the resonant frequency, nor does it alter heating efficiency. No readjustment is necessary, and on entering the pyrolysis reactor the optical fiber has the temperature required for receiving a hermetic coating of carbon.

BRIEF DESCRIPTION OF THE DRAWINGS

An embodiment of the invention is described by way of example with reference to the accompanying drawings, in which.

DETAILED DESCRIPTION

Figure 1:
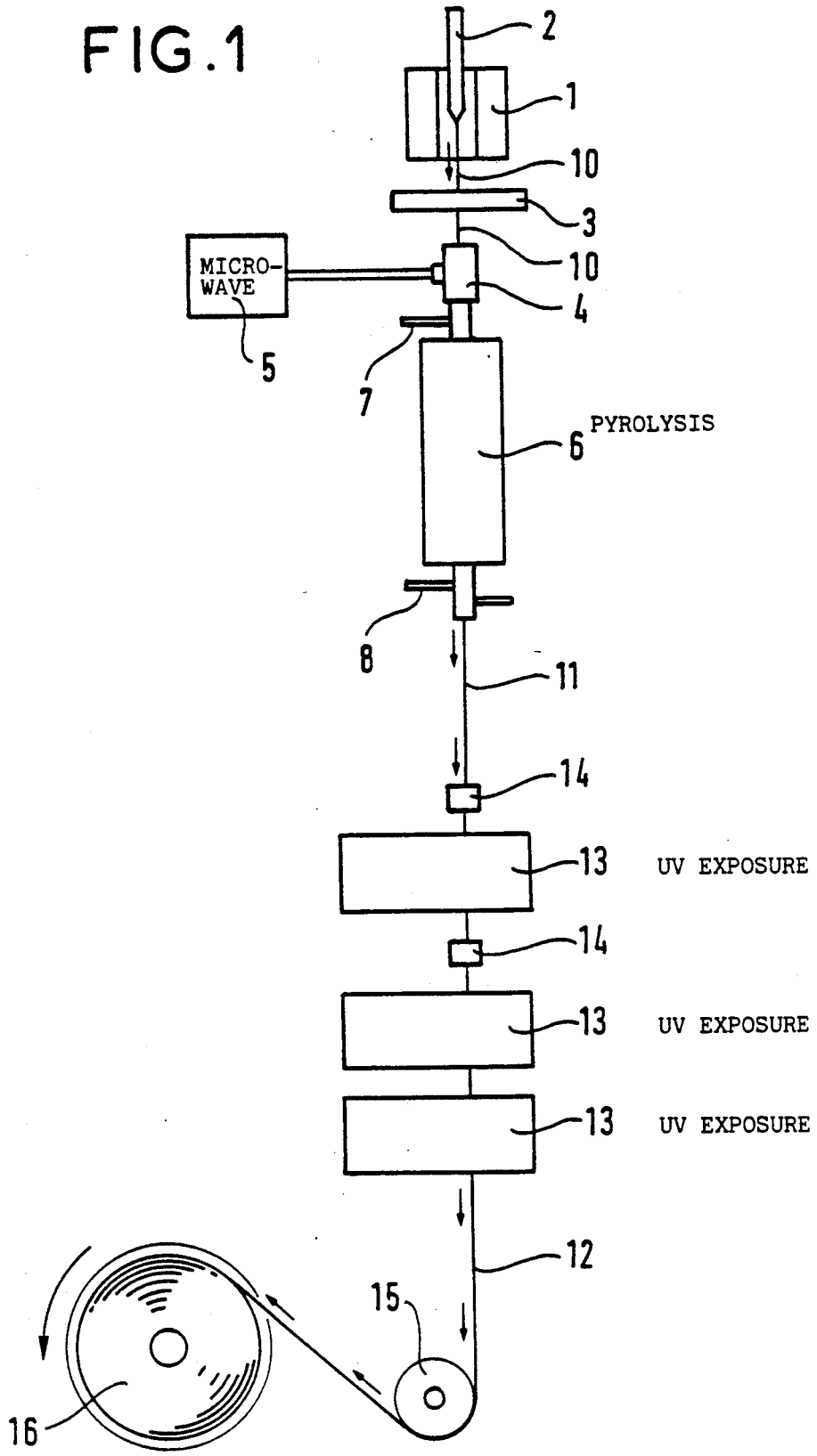
FIG. 1 is a diagram of a fiber-drawing tower in which apparatus of the invention is used.

FIG. 1 shows a fiber-drawing oven 1 containing a preform 2. The fiber-drawing speed is 150 meters per minute. The fiber 10 leaving the oven 1 passes through a device 3 for measuring its diameter. At this point it is at a temperature close to 900° C. It is inserted into a cavity 4 of the invention in association with a microwave generator 5 operating at 2.45 GHz. The cavity 4 is described below.

On leaving the cavity 4, the fiber 10 is at a temperature of about 1400° C. and it passes directly into a pyrolysis oven 6 which receives via a tube 7 at least one gas selected, for example, from saturated hydrocarbons such as methane, ethane, propane, and butane, and from non-saturated hydrocarbons such as acetylene, ethylene, propylene, butadiene, and mixtures thereof, and also from halogen-containing hydrocarbons, such as dichloromethane.

Reference 8 designates an outlet tube for extracting the residues of pyrolysis. The fiber 11 fitted with its carbon deposit then passes through sheathing dies 14 and UV irradiating boxes 13. The completed sheathed fiber referenced 12 then passes over a capstan 15 and is stored on a winder 16.

Figure 2:
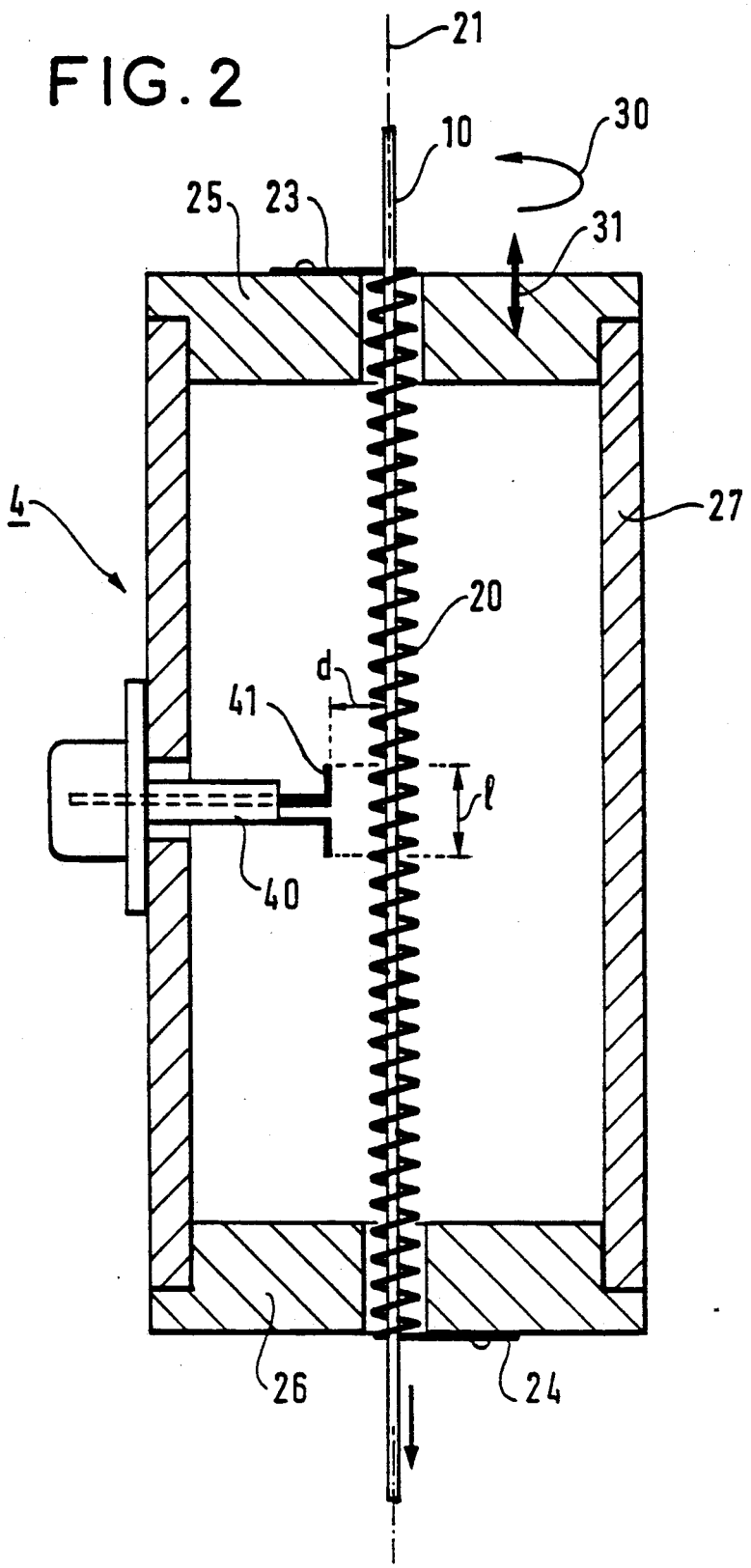
FIG. 2 is a diagram in partial section of a resonant cavity belonging to apparatus of the invention.

The cavity 4 of the invention is shown diagrammatically in FIG. 2. It essentially comprises a helix 20 having an axis 21 and a length of 100 mm, the helix being made of a metal wire having a diameter of 0.5 mm. The inside diameter of the helix proper is 3 mm and its pitch is about 2 mm to 3 mm. The helix 20 is made of a metal having good mechanical strength at high temperature: it may be made of rhodium-plated platinum or of a refractory alloy such as "Kanthal". The helix is fixed at its ends 23 and 24 to two respective short-circuit metal plates 25 and 26.

The helix is enclosed in a metal cylinder 27 which constitutes metal screening for the cavity 4 and which reduces any external disturbance.

The plate 25 can be adjusted in translation and in rotation as represented by arrows 30 and 31 in order to change the pitch and the diameter of the helix 20.

The microwave energy delivered by the generator 5 at 2.45 GHz is injected into the cavity 4 via a coaxial waveguide 40 which is terminated in a dipole antenna 41 whose dipole is parallel to the axis 21.

Antenna-helix coupling must be particularly well adjusted in order to ensure good energy transfer. The two parameters that enable coupling to be adjusted are the length l of the dipole and its distance d from the axis 21.

The diameter of the helix and its pitch are adjusted so that the resonant frequency of the cavity is 2.45 GHz.

In a variant embodiment (not shown), the coaxial waveguide 40 is replaced by a monomode waveguide having a rectangular section of 43 mm by 86 mm. The waveguide is disposed so that its 43 mm edges lie parallel to the axis 21. This ensures maximum coupling.

In an improvement, heater current may be caused to flow along the helix 20, e.g. 10A at 24 volts, thereby reducing the extent to which the fiber 10 is cooled by its environment. The short circuit plates 25 and 26 are then modified accordingly to enable an isolated electrical feed to be applied to the helix 20.

The invention is naturally not limited to the embodiment described above. Without going beyond the ambit of the invention, any means could be replaced by equivalent means.

We claim:

1. Apparatus for heating a silica optical fiber in a fiber-drawing installation including a fiber-drawing oven having an outlet, said apparatus being disposed at said outlet of said fiber-drawing oven to raise said optical fiber to a temperature greater than 1000° C., and comprising a microwave generator, a resonant cavity, coupling means for coupling said microwave generator to said resonant cavity, said resonant cavity comprising a helically-wound metal wire helix having an axis and being fixed at two ends thereof to two short-circuit metal plates respectively, and said optical fiber being adaptable for running substantially along said axis of said helix.

2. Apparatus according to claim 1, further including a coaxial waveguide terminated by a dipole antenna associated by said coupling means to said helix, the dipole antenna extending parallel to the axis of the helix.

3. Apparatus according to claim 2, further including means for adjusting the length of said dipole antenna and for adjusting a distance of the dipole antenna from the axis of said helix.

4. Apparatus according to claim 1, further including a rectangular section monomode waveguide having a short edge of said section lying parallel to the axis of the helix.

5. Apparatus according to claim 1, further including means for adjusting a pitch and a diameter of the helix, thereby adjusting a resonant frequency of said resonant cavity.

6. Apparatus according to claim 5, wherein said means for adjusting the pitch and the diameter of the helix comprises means for displacing at least one of said metal short circuit plates in one of rotation and translation.

7. Apparatus according to claim 1, further comprising a metal enclosure for enclosing said helix.

* * * * *